US005253451A

United States Patent [19]

Hörmann

[11] Patent Number: 5,253,451

[45] Date of Patent: Oct. 19, 1993

[54] DRIVING APPARATUS

[75] Inventor: Michael Hörmann, Marienfeld, Fed. Rep. of Germany

[73] Assignee: Marantec Antriebs - und Steuerungstechnik Gmbh & Co. Produktions oHG, Marienfeld, Fed. Rep. of Germany

[21] Appl. No.: 840,742

[22] Filed: Feb. 24, 1992

[30] Foreign Application Priority Data

Feb. 25, 1991 [DE] Fed. Rep. of Germany ..... 4105872

[51] Int. Cl.[5] ..... E05F 15/00

[52] U.S. Cl. ..... 49/139; 49/199

[58] Field of Search ..... 49/139, 199, 200, 360; 74/625

[56] References Cited

U.S. PATENT DOCUMENTS

| | | | |
|---|---|---|---|
| 3,526,994 | 9/1970 | Delaney | 49/199 |
| 3,722,141 | 3/1973 | Miller | 49/139 |
| 3,858,452 | 1/1975 | Gatland et al. | 49/139 X |
| 3,909,980 | 10/1975 | Courtney et al. | 49/199 |
| 4,107,877 | 8/1978 | Lee | 49/139 X |
| 4,131,830 | 12/1978 | Lee et al. | 49/139 X |
| 4,628,636 | 12/1986 | Folger | 49/139 X |
| 4,905,542 | 3/1990 | Burm et al. | 49/139 X |

*Primary Examiner*—Peter M. Cuomo

*Assistant Examiner*—Jerry Redman

*Attorney, Agent, or Firm*—Max Fogiel

[57] ABSTRACT

A driving apparatus for an object which can be moved to and fro such as a gate wing, comprising a guide block movable along a guide rail (1), said guide block being coupled to the object and to a driving member (2,2') movable by a motor and, with the aim of easy assemblage from only a small number of easily manufacturable components, consisting of a guide block component (3), having slidably supported thereon an actuating member (7), and of a manually actuated coupling member (5) spring-loaded towards the coupled position with the driving member, the actuating member (7) being in operative connection with the coupling member (5) through a bolt (8) stationary with said one member (7) and engaging at a sliding edge construction (9) formed in said other member (5) so that, when the actuating member (7) is displaced, the coupling member is brought against the direction of force of the spring acting thereon from the coupled position in the uncoupled position and automatically held in an end portion of the sliding edge construction in a rest position, while any displacement of the actuating member in the opposite direction will bring the coupling member under relief of the spring from the rest position again in the coupled position.

11 Claims, 2 Drawing Sheets 3
7
20
5
8
4
20
23
19
22

14
7
20
21
23
24
25
15
5
8
22
21
10
19
16
10
4
3
17
18
17

13
7
20
23
21
8
24
25
5
16
22
21
15
10
10
4
3
17
19
18

DRIVING APPARATUS

BACKGROUND OF THE INVENTION

This invention relates to a driving apparatus for an object which can be reciprocated between an opening and a closing position, such as the closing of a building or terrain in the form of a onepart or multipart gate wing, also a sliding gate wing (frequently crossbarred), shutter, weather shield or the like, especially a gate wing which is movable overhead, comprising a guide block which is motordriven along a guide rail and to which the said object (gate wing) is coupled, a manually operated locking mechanism being provided between a driving member moved by a driving motor along the guide rail and the said object (gate wing) with the aid of which the object (gate wing) can be coupled to and uncoupled from the driving member, for example, upon failure of the driving motor, and which comprises a coupling member movable along the guide rail and, in the coupled state, drivingly engaging the said driving member, particularly by form closure, the coupling member being embedded in a guide groove of the guide block approximately vertically to the direction of motion thereof so as to be slidable under the force of spring means between a coupling position and an uncoupling position, the spring force of the spring means acting on the coupling member towards the coupling position.

Manually operated locking systems of this type are known, for example, from the DE-PS 35 24 361 and U.S. Pat. No. 3,909,980. Here, however, the mechanical structure, i.e. number and/or intricacy of the components with view to their shape and manoeuvrability when being assembled as well as safe operation are not satisfying in every respect.

In the first line, this locking mechanism is to manually interrupt the connection from a motor driving unit to an object (gate wing), for instance upon failure of the driving system. In addition, within the scope of the first-mentioned German patent specification there is made sure that any uncoupling between the driving system and the object is possible only under certain conditions, avoiding danger caused by the uncoupling of the object and the driving system which—like in the present application—is explained with a gate wing. Because, when the weight balancing system of the gate wing fails to work the driving system which then alone supports the gate wing must not be separable from the gate wing. This aspect can be taken into consideration also within the scope of the subject of the present application which, however, is not necessary.

SUMMARY OF THE INVENTION

The invention is based on the object of providing a driving apparatus with a locking system which can be easily assembled from only a small number of components which are easy to manufacture, respectively have a simple geometrical shape. At the same time, provisions are to be made for manual actuation of the locking system both via the closing system of the object, particularly the gate wing, and—with the example of a garage—from the interior thereof.

Starting from a driving apparatus having the above-mentioned features, this object is solved according to the invention in that the guide block has slidably supported thereon an actuating member connected to the coupling member through a bolt stationary with said one member, said bolt engaging a sliding edge construction formed in said other member, the sliding edge construction consisting of a rest section approximately vertically extending to the direction of force of the spring means and an actuating section extending thereto at an angle which is larger than 90° and smaller than 180° such that when the actuating member is displaced in that direction where the bolt at first engages the actuating section of the sliding edge construction and thereafter the rest section thereof the coupling member is displaced against the force of the spring means from its coupled position to its uncoupled position and, after having reached the rest section, is automatically held there until the coupling member under relief of the spring resumes the coupled position with the driving member by a repeated, externally initiated displacement of the actuating member in the opposite direction away from the rest section towards the area of the actuating section of the sliding edge construction.

Accordingly, the locking system consists of only a small number of components which are geometrically simply shaped and easy to assemble. The coupling member engages at a driving member of a driving motor unit, being practically linearly moved along a guide rail where the guide block component is slidably guided. Talking about a guide block component here also means that the same can as well form the entire guide block, depending on how the guide arrangement is made. The coupling state between the coupling member and the driving member can principally be effected non-positively, for instance, when a rope is used as the driving member which, if necessary under involvement of the guide block component, is then received by the coupling member in the coupling position, if possible deforming from its linear extension. Normally, a coupling counterpart will be provided which is arranged on the driving member, if necessary as a connecting piece between two open ends of an endless driving member such as a rope or chain or, however, as the end piece of a train of two meshing part-trains composable and decomposable along the guide rail and capable of receiving pressure and tensile loads. Such a coupling counterpart can provide a recess or similar construction for the engagement of the coupling member in the coupling position, if necessary through a coupling element formed thereon. Conveyance of the coupling member, respectively its coupling element between the coupling and uncoupling position then takes place by means of the locking system according to the invention in that the coupling member is brought into engagement with the coupling element approximately vertically to the travelling path of the driving member (state of operation with motor drive) or, however, in that the coupling member is removed from this engaged position by an oppositely directed displacement (in case of a gate operation without motor drive).

The sliding edge construction, where the bolt engages at, can be formed in an opening which outside of this sliding edge guidance can have an arbitrary border, in a preferred embodiment the sliding edge construction being formed in the edge portion of a correspondingly angularly extending elongated hole. Preferably, the angle between the displacement path of the actuating member and the actuating section of the sliding edge construction is less than 45° and still more preferably approximately 30°, whereby a translation of motion between the motion path of the actuating member and that of the coupling member vertically moved relative thereto is obtained in terms of an easier actuation against the force of the spring means.

Principally, the guidance of displacement of the actuating member can be provided at an angle to the direction of motion of the guide block along the guide rail, in a preferred embodiment the said guidance of displacement extending parallel to the path of motion of the guide block and because of that to the guide rail.

The allocation of the bolt to said one member and that of the sliding edge construction to said other member is freely selectible with respect to the actuating member and the coupling member, in a preferred embodiment the sliding edge construction, respectively the angularly extending elongated hole providing this sliding edge construction being formed in the coupling member and the bolt being fixed in the actuating member.

When the actuating member is stably guided over the displacement path along the guide block any guidance of the bolt by the guide block can be omitted. However, in a further preferred embodiment there can be provided in the guide block component an elongated hole extending in the direction of the rest section, namely in this respect on both sides of the coupling member which is supported within a corresponding recess of the guide block component and guided along the displacement path of the bolt and permanently penetrated by said bolt.

In order to enable an actuation by a remote manual actuating member, for example the handle on the outside of a garage door which door wing is movable through the locking system with the aid of the drive system, there is provided on the actuating member a corresponding cavity for receiving a traction rope which is correspondingly guided to the remote manual actuating member and upon its actuation the locking system is brought in its uncoupled state. In a preferred embodiment the traction rope is in the form of a Bowden cable, a retaining cavity for receiving the core and supporting means for receiving the sheath of the Bowden cable being formed on the actuating member and on the guide block component approximately in alignment with the direction of displacement of the actuating member.

DESCRIPTION OF THE PREFERRED EMBODIMENTS

Figure 1:
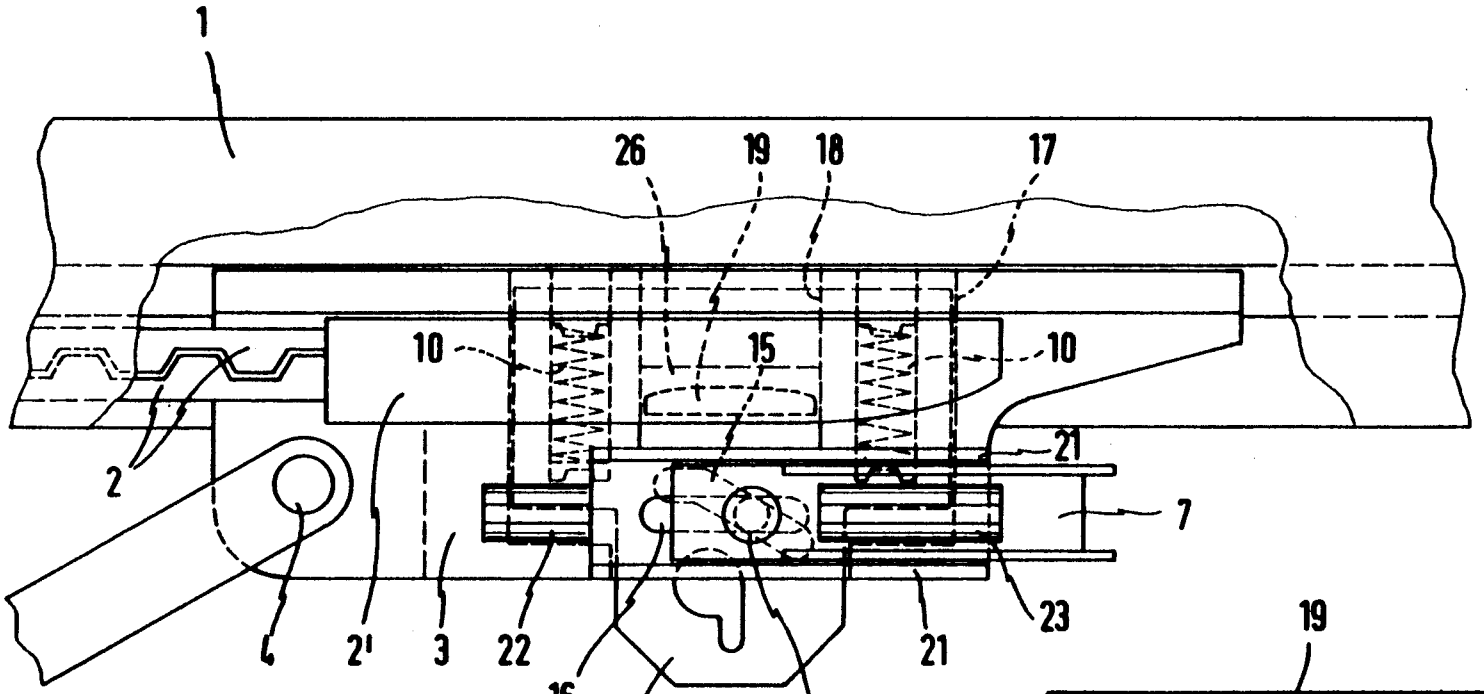
FIG. 1—An outline of a guide rail with a guide block comprising a locking system.
Figure 5:
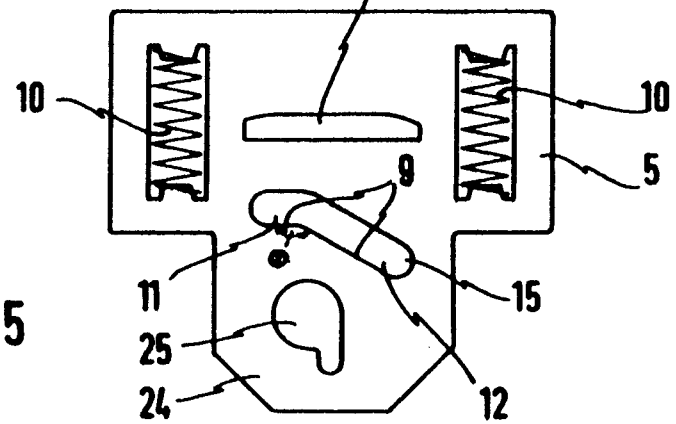
FIG. 5—A front view of the guide block component according to FIGS. 2 and 3.

There is indicated on guide rail 1 a driving member 2 with a coupling counterpart 2' to which a guide block component 3, here forming the entire guide block, is coupled, said guide block component being guided for longitudinal displacement along the guide rail approximately parallel to the direction of motion of the driving member 2. In a manner not shown in detail, the guide block component 3 is connected at position 4 to an object movable by the guide block, in the present case especially a door wing, for example by a connecting rod rotatably supported on its both ends. In a way which is to explained in more detail, there is slidably supported in the guide block component 3 a coupling member 5 vertically to the motional direction of displacement of the guide block component 3 which—like shown—in the coupled position with a coupling element 19 engages in a correspondingly adapted cavity 26 of the coupling counterpart 2' and leaves this cavity 26 when the coupling member 5 is manually displaced in a manner still to be described in more detail so that a difference exists between a coupled position like the one which is shown and an uncoupled position such as required e.g. for manual actuation of the object, such as a door wing, for the event that the driving motor is out of order. While in the coupled position a form-fit connection exists between the coupling counterpart 2' and the guide block component 3, so that the latter is movably taken along by the driving member in the longitudinal direction of the guide rail, this slaving connection is completely omitted in the uncoupled state so that the guide block can be moved along the guide rail 1 free of the driving member, respectively its coupling counterpart.

The remaining Figures more clearly reflect the construction of the locking system on the guide block component 3 according to the invention. The coupling member 5 is inserted in a recess 17 adapted to the cross-sectional shape of the coupling member 5, the cross-section thereof being viewed in its direction of displacement, and said recess 17 being provided with a lateral breaking-through 18 through which the coupling element 19 formed on one of the broadsides of the coupling member 5 projects. On the guide block 3 there is movably guided an actuating member 7 parallel to the guiding direction of displacement of the guide block component 3 on guide rail 1. The actuating member 7 as a whole is U-shaped and engages with its two legs 20 at the outer sides of the guide block component 3, respectively. The lateral borders of the legs 20 are displaceably guided between projections 21 formed like landing skids which are correspondingly projectingly formed on the respective outer sides of the guide block component 3. Following the said U-shape, the actuating member 7 contains a wide groove or channel wherein a traction rope, Bowden cable or the like can be received. On the outside of the one leg 20 of the actuating member 7 and in alignment with it there are provided on the associated one of the outer surfaces of the guide block component 3 constructions for the receipt of an actuating traction rope or a Bowden cable. In the latter case, the core of the Bowden cable is received in a supporting structure 22 associated to the guide block component 3 and the sheath thereof in a supporting structure 23 associated to said one leg 20 of the actuating member or vice versa. In the case of a traction rope the same can be fixed within 22 and, being guided around the actuating member 7, connected to the remote manual actuating part. Here, a great number of optional arrangements exists.

Figures 2, 3, 4:
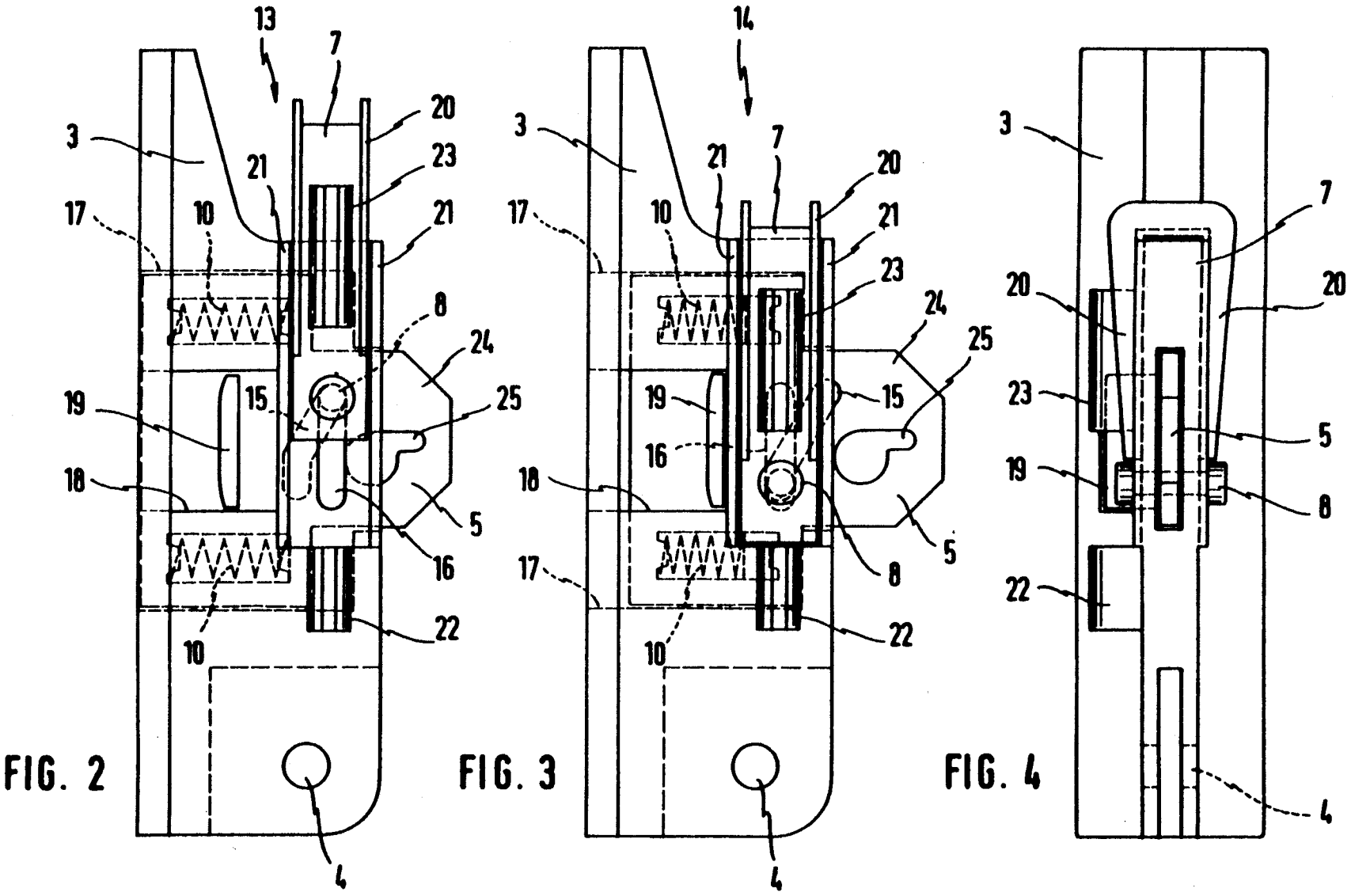
FIG. 2—A side view of the guide block component with the locking system, the coupling member being displaced to the coupling position.
FIG. 3—A side view according to FIG. 2, however, with the coupling member being brought in its uncoupled position.
FIG. 4—A side view of the coupling member.

As shown particularly in FIG. 4, there is formed in the plane coupling member 5 an angularly extending elongate hole 15, one lateral border thereof providing the sliding edge construction 9 which consists of a rest section 11 of shorter length and an actuating section 12 of longer length. The rest section extends vertically to the direction of force of the spring means 10 which consist of two pressure springs inserted on both sides of the coupling element 19 in recesses of the coupling member 5 so as to be slightly biassed. The actuating section 12 extends at an angle of approximately 30°, deviating from the course of the rest section 11, and accordingly joins the rest section under an angle $\theta$ of approximately 150° if one looks at the elongate hole 15 from that outside which joins the sliding edge construction such as shown in the Figure.

In FIGS. 2 and 3 there is provided in both cheeks of the guide block component 3 on both sides of the recess 17 for the receipt of the coupling member 5 in the area overlapped at the displacement of the actuating member 7 an elongate hole-shaped recess 16, respectively, which in respect of its length extends at least over the length of the elongate hole 15, viewed in projection towards the direction of force of the spring means 10. A bolt 8 penetrates a corresponding bore, respectively in the end portions of the legs 20 of the actuating member 7 under penetration of the two elongate recesses 16 of the guide block component 3 and of the angularly extending elongate hole 15 in the coupling member 5. In FIG. 2 there is represented the coupled position of the coupling member 5 when the same reaches its leftwardly directed end position of displacement, the bolt 8 assuming the end position of that portion of the elongate hole 15 area which comprises the actuating section 12. The actuating member 7 is displaced correspondingly, since the bolt 8 is held on the actuating member practically without any clearance. When the locking system is now to be brought in the uncoupled state, the actuating member 7 is moved downwardly in the drawings either by a traction rope or Bowden cable, namely via a remote actuating element, for instance the outside handle of a garage door as the object which is moved or by pressing down the actuating member directly by hand from the inside of the garage. By virtue of the guidance of the actuating member 7 on the guide block component 3 and in this respect of the bolt 8 in the elongate recesses 16, the bolt 8, which engages at the actuating portion 12 of the sliding edge construction 9 of the elongate hole 15, forces the coupling member 5 slidably guided in the recess 17 of the guide block component 3 vertically to the movement of the actuating member 7 to move under compression of the springs 10 rightwardly to the uncoupling position wherein the coupling element 19 is out of engagement with the coupling counterpart of the driving member. Thereafter, the bolt 8 passes from the actuating section 12 to the rest section 11 of the sliding edge construction 9 of the elongate hole 15, whereby the displacement of the coupling member 5 is concluded. By virtue of the extension of the rest section 11 vertical to the direction of force of the springs 10, respectively the guidance of displacement for the coupling member, the latter remains in the uncoupled position until the actuating member 7 is moved in the reverse direction of displacement so that the bolt 8 passes from the rest section 11 to the inclined actuating section 12 of the sliding edge construction 9. In this instance the coupling part 5 is moved under the force of the relieving springs 10 towards the coupling position which is completely assumed as soon as the bolt 8 again locates in the end of the buckled elongate hole 15 opposite to the rest section 11. By virtue of the elongate hole construction the dynamic effect of the springs can be principally supported by the engagement of the bolt 8 at the border of the elongate hole 15 through the actuating section 12.

In the end portion 24 of the coupling member 5 on the coupling element 19, a hang-in opening 25 is provided into which the thickened end of a rope can be hung. When the rope is loaded by tension in the direction of displacement of the coupling member 5 the locking system can be uncoupled against the force of the springs 10 for the duration of the tensile load, for example, in order to make adjustments.

I claim:

1. A drive for a member moving back-and-forth between a closed position and an open position particularly building or terrain closures in form of at least a one-part door, sliding door, shutter, weather shield, or overhead movable door, said drive comprising: a guide block on a guide rail; motor means for driving said guide block along said rail, said guide block being connected to said member; a manually-actuated locking system between a driving element moved along said guide rail by said motor means and said member for connecting and disconnecting said member from said driving element when said motor means fails; said locking system having a guide block component movable along said guide rail and a coupling element engaging drivingly said driving element when in a coupled state; said guide block component having a guide recess for holding movably said coupling element substantially vertically with respect to a direction of motion of said guide block component; spring means having a force acting on said coupling element to slide said coupling element between a coupling position and an uncoupling position, said force of said spring means urging said coupling element towards said coupling position; an actuating element slidable on said guide block component and operatively connected to said coupling element through a bolt stationary with said actuating element; said coupling element having sliding edge means formed in said coupling element and engaged by said bolt; said sliding edge means having a rest section extending substantially perpendicular to a direction of said force of said spring means, and having an actuating section extending inclined to said direction of said force at an angle between 90° and 180°, said locking system being a two-part system of said coupling element and said actuating element connected together by said bolt and said sliding edge.

2. A drive as defined in claim 1, wherein said sliding edge means is formed in the border area of a correspondingly angularly extended elongated opening.

3. A drive as defined in claim 1, wherein an angle between said rest section and said actuating section is substantially 150 degrees.

4. A drive as defined in claim 1, wherein said actuating element is slidably guided and held on said guide block component substantially parallel to a direction of motion of said guide block component.

5. A drive as defined in claim 1, wherein said sliding edge means is in said coupling element and said bolt is fixed to said actuating element.

6. A drive as defined in claim 1, wherein said bolt penetrates an elongaged opening holding said sliding edge means and formed in said coupling element, said guide block component having formed therein at least one elongated recess extending towards said rest section of said sliding edge means.

7. A drive as defined in claim 1, wherein said coupling element is slidably supported in a recess penetrating said guide block component and dimensioned to correspond with clearance to outer dimensions of a cross-sectional shape of said coupling element when viewed in direction of displacement of said coupling element, said recess having an opening penetrated by a coupling part formed on said coupling element; said spring means comprising two parallel helical springs embedded in said coupling element and supported with protruding portions on ends of said helical springs.

8. A drive as defined in claim 1, wherein said actuating element is U-shaped and surrounds said guide block component with legs slidably guided longitudinally by projections on a surface of said guide block component.

9. A drive as defined in claim 1, including holding means on said guide block component; supporting means on said actuating element, said holding means and said supporting means receiving a core and sheath of a Bowden cable for displacing said actuating element relative to said guide block component in response to closing and opening means on said door member.

10. A drive as defined in claim 1, wherein said coupling element has an end portion with an opening for fixing a traction rope to uncouple said coupling element from said driving element.

11. A drive for a member moving back-and-forth between a closed position and an open position particularly building or terrain closures in form of at least a one-part door, sliding door, shutter, weather shield, or overhead movable door, said drive comprising: a guide block on a guide rail; motor means for driving said guide block along said rail, said guide block being connected to said member; a manually-actuated locking system between a driving element moved along said guide rail by said motor means and said member for connecting and disconnecting said member from said driving element when said motor means fails; said locking system having a guide block component movable along said guide rail and a coupling element engaging drivingly said driving element when in a coupled state; said guide block component having a guide recess for holding movably said coupling element substantially vertically with respect to a direction of motion of said guide block component; spring means having a force acting on said coupling element to slide said coupling element between a coupling position and an uncoupling position, said force of said spring means urging said coupling element towards said coupling position; an actuating element slidable on said guide block component and operatively connected to said coupling element through a bolt stationary with said actuating element; said coupling element having sliding edge means formed in said coupling element and engaged by said bolt; said sliding edge means having a rest section extending substantially perpendicular to a direction of said force of said spring means, and having an actuating section extending inclined to said direction of said force at an angle between 90° and 180°, said locking system being a two-part system of said coupling element and said actuating element connected together by said bolt and said sliding edge; said sliding edge means being formed in a border area of a correspondingly angularly extended elongated opening; said rest section forming an angle with said actuating section of substantially 150 degrees; said actuating element being slidably guided and held on said guide block component substantially parallel to a direction of motion of said guide block component; said sliding edge means being in said coupling element and said bolt being fixed to said actuating element; said bolt penetrating an elongated opening holding said sliding edge means and formed in said coupling element, said guide block component having formed therein at least one elongated recess extending toward said rest section of said sliding edge means; said coupling element being slidably supported in a recess penetrating said guide block component and dimension to correspond with clearance to outer dimensions of a cross-sectional shape of said coupling element when viewed in direction of displacement of said coupling element, said recess having an opening penetrated by a coupling part formed on said coupling element; said spring means comprising two parallel helical springs embedded in said coupling element and supported with protruding portions on ends of said helical springs; said actuating element being U-shaped and surrounding said guide block component with legs slidably guided longitudinally by projections on a surface of said guide block component; holding means on said guide block component; supporting means on said actuating element, said holding means and said supporting means receiving a core and sheath of a Bowden cable for displacing said actuating element relative to said guide block component in response to closing and opening means on said door member; said coupling element having an end portion with an opening for fixing a traction rope to uncouple said coupling element from said driving element.

* * * * *